US009239571B2

(12) United States Patent
Patton

(10) Patent No.: US 9,239,571 B2
(45) Date of Patent: Jan. 19, 2016

(54) WORKOUT CYCLE EMPLOYED IN A TIME MEASUREMENT PORTABLE DEVICE

(71) Applicant: Thomas Patton, Panama (PA)

(72) Inventor: Thomas Patton, Panama (PA)

( * ) Notice: Subject to any disclaimer, the term of this patent is extended or adjusted under 35 U.S.C. 154(b) by 0 days.

(21) Appl. No.: 14/334,646

(22) Filed: Jul. 17, 2014

(65) Prior Publication Data

US 2015/0309480 A1 Oct. 29, 2015

(30) Foreign Application Priority Data

Apr. 25, 2014 (PA) ..... 90190-01

(51) Int. Cl.
*G04G 15/00* (2006.01)
*G04F 5/00* (2006.01)

(52) U.S. Cl.
CPC ..... *G04G 15/003* (2013.01); *G04F 5/00* (2013.01)

(58) Field of Classification Search
CPC ..... G04G 15/003; G04G 15/006; G04F 3/06; G04F 5/00
USPC ..... 368/89
See application file for complete search history.

(56) References Cited

U.S. PATENT DOCUMENTS 4,337,529 A * 6/1982 Morokawa ..... 377/20
4,831,605 A * 5/1989 Suga ..... 368/113
5,050,141 A * 9/1991 Thinesen ..... 368/73
5,812,049 A * 9/1998 Uzi ..... G07C 1/24 340/323 R
6,816,442 B1 * 11/2004 Heiman et al. ..... 368/107
8,054,174 B1 * 11/2011 Uehran ..... 340/539.11
2003/0021189 A1 * 1/2003 Streja ..... 368/62
2005/0128879 A1 * 6/2005 Sanford et al. ..... G04F 1/005 368/109
2007/0183269 A1 * 8/2007 Baba ..... 368/110
2012/0075959 A1 * 3/2012 Keith ..... 368/11
2012/0287758 A1 * 11/2012 Lin ..... 368/47
2013/0041590 A1 * 2/2013 Burich et al. ..... 702/19
2015/0063081 A1 * 3/2015 Sharples ..... A63B 71/0686 368/101

* cited by examiner

*Primary Examiner* — Sean Kayes

(74) *Attorney, Agent, or Firm* — Law Office of Jeff Williams; J. Oliver Williams

(57) ABSTRACT

Portable device for time measurement that counts with the basic functions of time and date, alarm, Timer, Stopwatch, Fixed Interval Timer function, as well as a Variable Interval Timer function. This Variable Interval Timer function allows the user to program multiple different workout or rest intervals, each with a different established time, and without limitation to an amount of fixed and unalterable workout and rest rounds. The user is able to program intervals in order to increase or decrease the workout or rest time. In the same way the user may decide to create intervals of different exercises, some of them for a short time and some of them for a longer time, as well as the rest time. Finally, the user may program the watch to alert them that a change of interval is coming using several different alarms for the different intervals.

7 Claims, 4 Drawing Sheets

WORKOUT CYCLE EMPLOYED IN A TIME MEASUREMENT PORTABLE DEVICE

BACKGROUND

1. Field of the Invention

The following invention refers to a workout cycle employed in a time measurement portable device and the device that employs it, and specifically, the invention relates such devices as personal digital watches employed for sport trainings.

2. Description of Related Art

Nowadays there is a lot of favorable information and, thus, many followers of exercise and interval training. It is believed that training by alternating intervals of workout and rest time, or alternating cycles of intense workout and rest, or intense workout cycles and less intense workout cycles, provides equal, if not even better results in much less time than a session of middle intensity and long duration.

Current basic personal watches have only Timer and Stopwatch functions. The Stopwatch function allows starting the meter at the beginning and stopping or pausing it at the end or interruption of the activity, in order to have the total time of the session as a reference. The Timer function performs a regressive countdown starting at the time one designates until reaching zero, used for a session of exercise for limited time.

There are no other available tools for interval workout for gym clients or smartphone users apart from the limited personal watches with the Timer and Stopwatch functions, some smartphone apps and big special wall clocks for gyms, with the capacity of programming one kind of interval workout that allows to program X seconds of workout and Y seconds of rest by Z amount of fixed rounds. We will 5 denominate this as Fixed Interval Timer (FIT).

Although great strides have been made in head coverings, considerable shortcomings remain.

SUMMARY OF THE INVENTION

It is then the goal of the present invention to provide a workout cycle employed in a time measurement portable device, where the workout cycle is employed in a time measurement device taking into account that the said cycle features a function called Variable Interval Timer (VIT). With this function the user is able to program multiple time values in the beginning of their activity, and the Timer will run one after another at the end of each cycle without the intervention of the user. At the end of each cycle, the VIT will alert the user that the said cycle has finished and will start running the new cycle. The VIT will execute all the cycles programmed by the user until the end of all cycles and then will stop.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
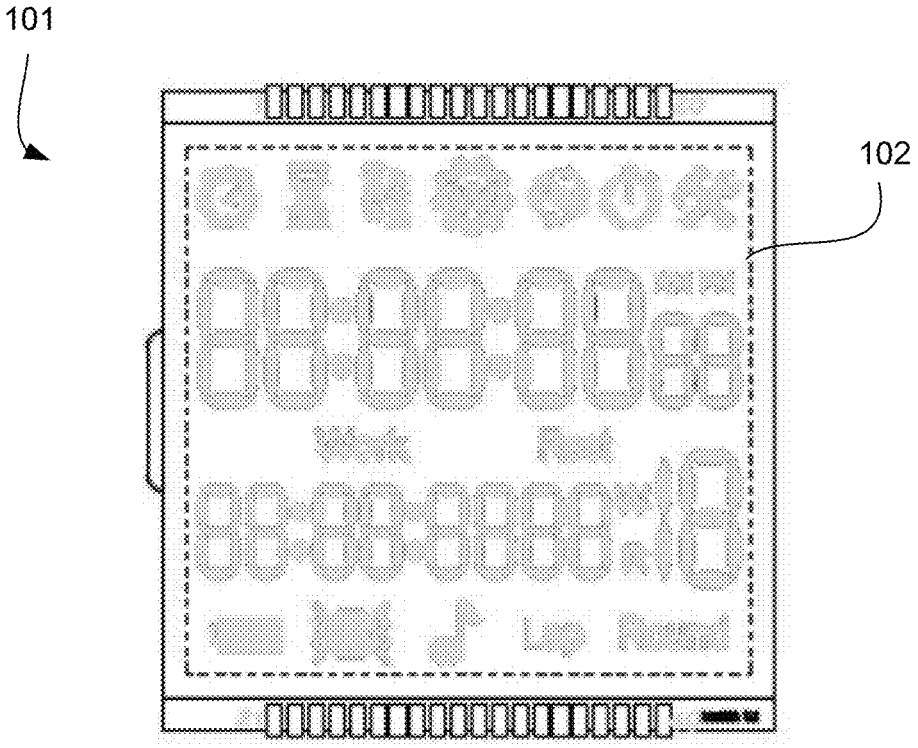
FIG. 1 illustrates a display in a time measurement device according to the preferred embodiment of the present application.

While the system and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the device described herein may be oriented in any desired direction.

Referring now to FIGS. 1-4 in the drawings, a portable time measurement device 101 is illustrated. The object of this invention is a portable time measurement device 101 that features basic functions such as time and date 103, alarm 105, Timer 107, and a stopwatch functionality 109. Such functions may be seen in FIG. 2 for projection on a display 102 of measurement device 101. It is understood that each above feature is optional and as such, device 101 is not limited to only those features listed. In particular, measurement device 101 includes a Fixed Interval Timer (FIT) function 111 and a Variable Interval Timer (VIT) function 113 as well. Measurement device 101 is configured to allow a user to program multiple (from 1 up to 20 or more in this specific model) different workout timed cycles or rest intervals, each one with a different previously established time, and without limitation to an X amount of fixed and unalterable workout and rest rounds. In this way the user is able to program their time intervals in order to increase or decrease their workout or rest time, as desired. In the same way the user may decide to create time intervals of different exercises, some of them for a short time and some of them for a longer time, as well as the rest time. Finally, the user may program the watch to alert them that a change of time interval is coming using several different alarms for the different intervals.

In addition, variable interval time function 113 is configured to operate with fixed interval timer function 111. VIT function 113 allows the user to use the FIT function 111 in an individual way (may it be training alone in the gym or outdoors in a park, for example), which currently is a function limited to the big wall clocks for gyms or smartphones, that many times aren't comfortable to manipulate while exercising as they cannot get damp with the rain or wet with the sweat, or receive shocks while the user is working out.

Other additional characteristic of the VIT function 113 is the vibration and/or sound alert option at the moment when a change between workout and rest time is close, so there is no need to look at the watch or listen to the watch, as the user may prefer listen to music while exercising. Currently, while working out, the user has the need to look at a cell-phone screen (that tends turn off after a while) or a wall clock. Alarm 105 is configured to provide the user an alert that a time interval has completed and that another is about to begin without the need to view display 102. This notification is received by the user without the need of the visual display 102. Additionally, a user is able to select the type of alarm to be used at the completion of each time interval.

It is highlighted then that the object of this invention allows programming a training in order to combine and diversify it by time intervals through the VIT function 113. It allows the user to have for personal use those functions that previously were limited to gyms or that were available in electronic devices that are not efficient for working out. For example, the Fixed Interval Timer of the wall clocks or smartphones. The invention also allows the user to bring their imagination as far as they want with the time intervals, all in their wrist, and even without having the need to look at it thanks to the vibration and/or sound alert that warns them a few seconds before the interval change. Device 101 is configured to be portable and attach to any portion of the user's body. For example, device 101 may be coupled to a user's wrist or around the upper arm. Device 101 may further be coupled to a bike or other piece of equipment adjacent to the user during the training workout.

As it is known, currently, when a person desires to introduce variation to their intervals, they ought to do it on the go, by looking at a common wall clock and calculating at the same time when to start or stop, which is difficult while they are focused on and/or tired of exercising.

Figure 2:
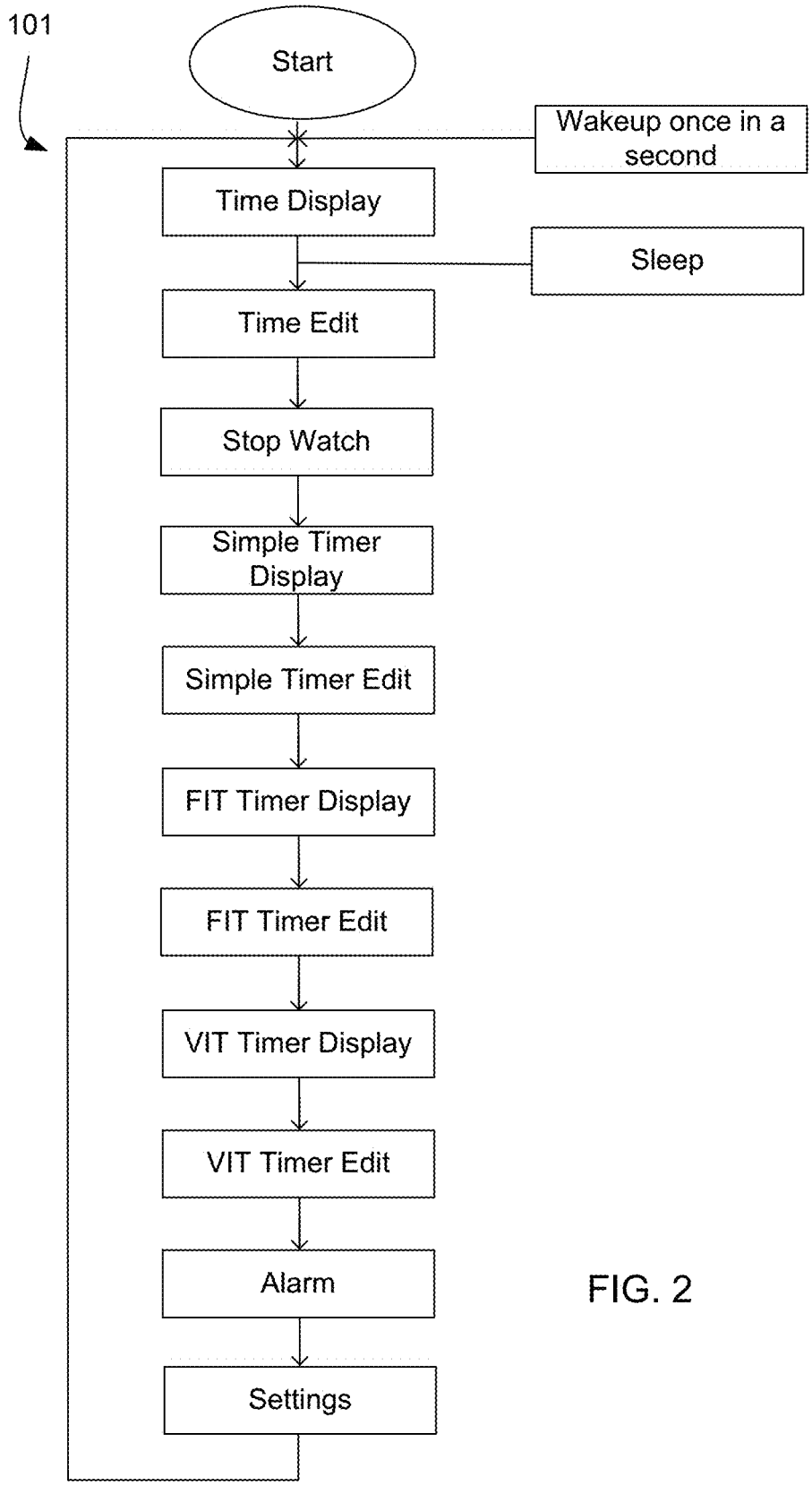
FIG. 2 is a flowchart that describes software employed in the time measurement device of FIG. 1.

The FIG. 2 shows the flowchart that illustrates the phases of the software employed in the device of this invention. In the conventional watches the user is only able to program a unique value of Time each time. Through the use of the VIT function 113, the user is able to program multiple values of time intervals at the beginning of their activity and the VIT function 113 will run each time interval in consecutive order one after another without further intervention of the user. At the end of each time interval or cycle, the VIT function 113 will alert the user that said cycle has finished and the next one is about to start. The VIT function 113 will execute all the cycles programmed by the user until their end and then will stop. It is highlighted that device 101 will have the capacity to program from 1 up to N amount of cycles.

Figure 3:
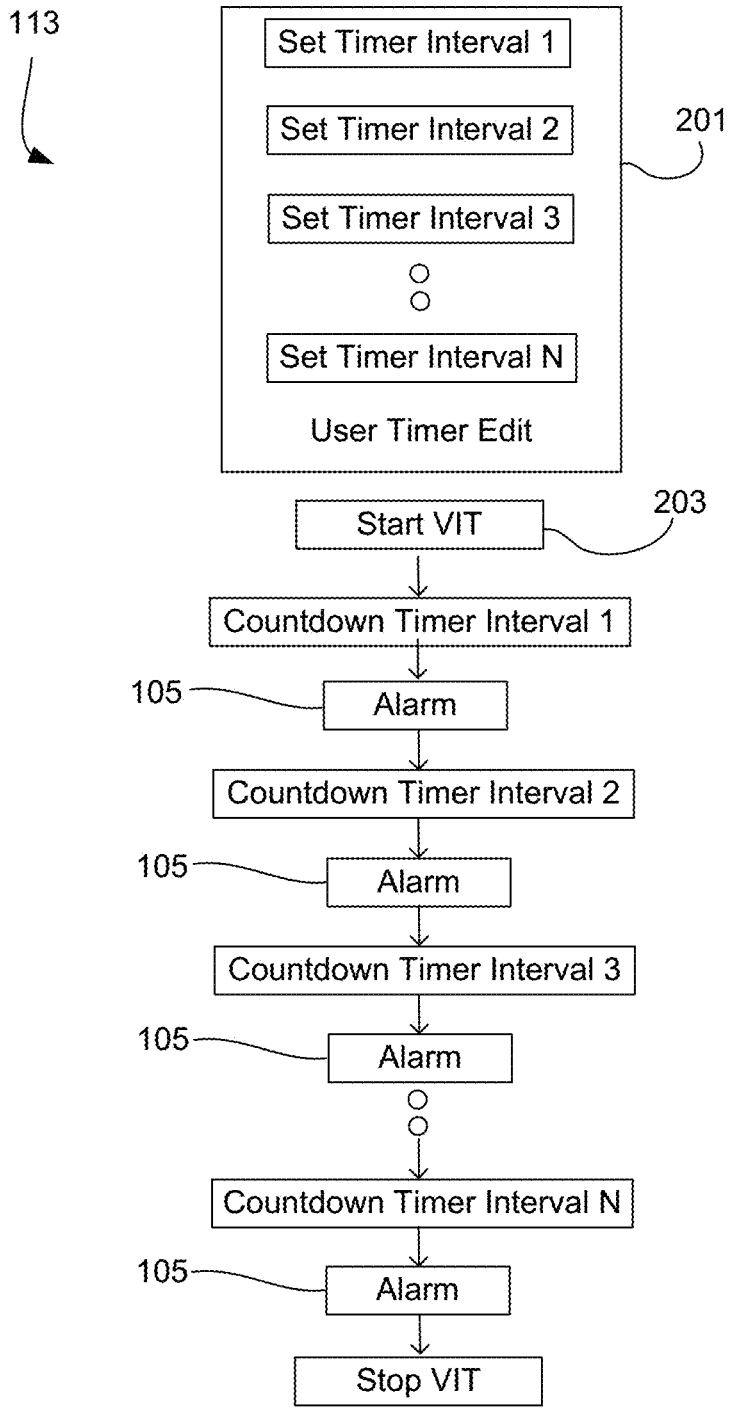
FIG. 3 is a flowchart that illustrates the use of a VIT function in the time measurement device of FIG. 1.

FIG. 3 shows the flowchart that illustrates the VIT function 113 of device 101 of this invention. Indeed, it allows the user to program 1, 2, 3, . . . N different time intervals through display 102. Selection of different time intervals 201 are made with respect to workout cycle time intervals and rest intervals. Once the interval times are programmed, the user sets Start 203 in the device when starting their sport routine or desired activity. In that moment the VIT function 113 starts the first time cycle. When the first time cycle finishes, an alert 105 notifies the user that the first cycle has finished and the second cycle starts. The second cycle may be a rest time or may alternatively be another work time wherein the workout performed is modified from the prior workout time. This pattern of a countdown of time interval and an alarm is repeated until all the intervals or cycles programmed by the user are finished.

Figure 4:
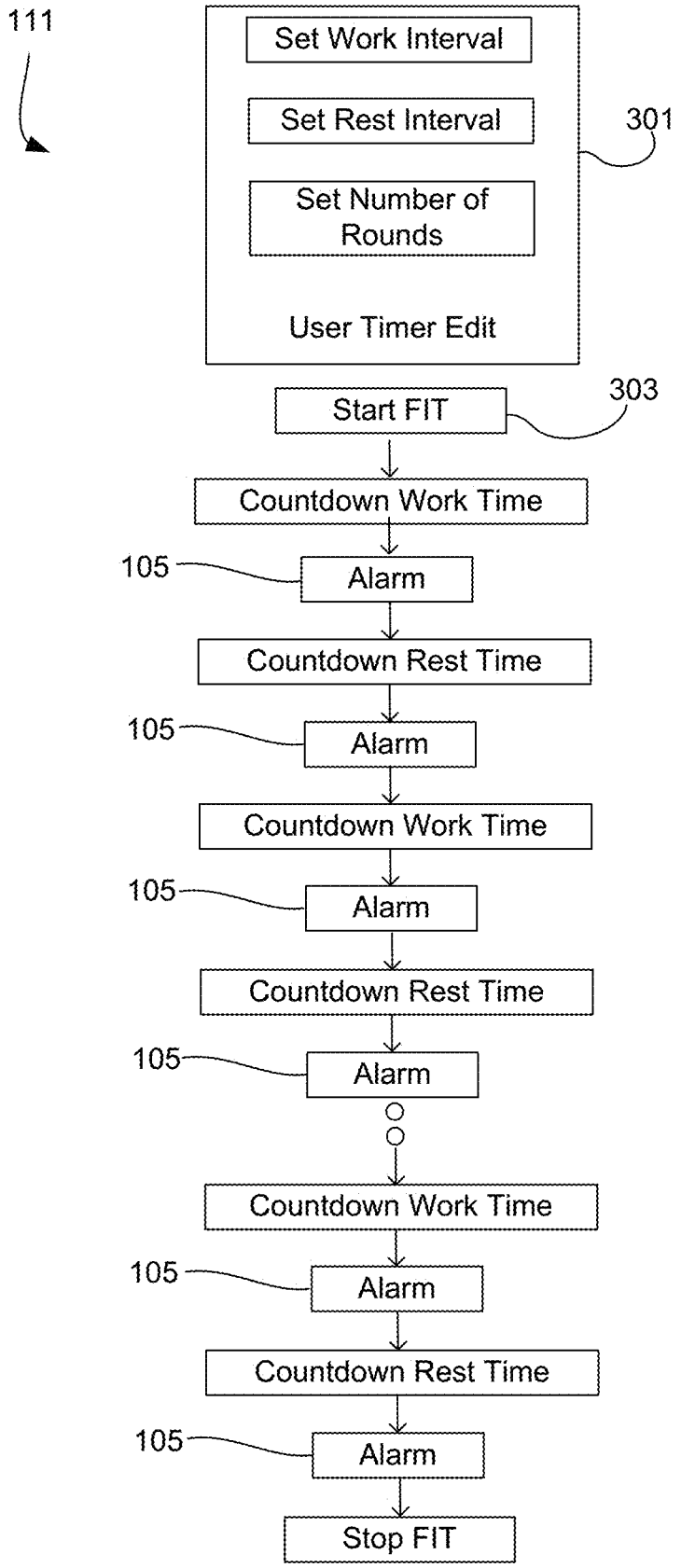
FIG. 4 is a flowchart that illustrates the use of a FIT function in the time measurement device of FIG. 1.

FIG. 4 shows the flowchart that illustrates the FIT function 111 provided by the device of this invention. Here, the user may program 301 the workout and rest intervals, and the amount of cycles that they choose to perform. Once the programming is set, the user starts 303 their exercise routine with the FIT function 111 of the device 101. The FIT function 111 will start with the countdown of the workout time, which when finished will activate an alarm 105. The rest cycle begins immediately and when finished, the user is also notified by an alarm 105. It is highlighted that the FIT function 111 will run until the end of the steps programmed by the user.

It is understood that display 105 may be an LCD display. Additionally the user may operate any of the functions of device 101 through external buttons or knobs via mode selection or through touch screen technology thereby permitting a user to operate the one or more functions directly through display 105. It is also understood that device 101 may be utilized in a watch or may be a program functionable with a portable electronic device such as a cell phone, portable electronic tablet device or other handheld electronic device.

The current application has many advantages over the prior art including at least the following: (1) ability to program multiple different workout timed cycles or rest intervals, each one with a different previously established time; (2) each timed cycle or rest interval being without limitation to an X amount of fixed and unalterable workout and rest rounds; (3) nonvisual notification of the completion of a timed cycle; and (4) ability to modify the type alert provided at each interval.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A workout cycle employed in a time measurement device, the workout cycle comprising:

a variable interval timer function configured to allow a user to program multiple time values at the beginning of an activity, the multiple time values running consecutively without intervention of the user;

an alarm in communication with the variable interval timer function, the alarm configured to alert the user at the conclusion of a time value;

a fixed interval timer configured to permit the user to program workout and rest intervals and an amount of cycles the user chooses to perform; the fixed interval timer configured to selectively begin a countdown of time, the fixed interval timer in communication with the alarm to alert the user upon completion of the countdown;

wherein the variable interval timer function is programmed to stop at the conclusion of all time values;

wherein the workout cycle employed in a time measurement device utilizes a software phase flowchart consisting in:

a start with a one second wakeup;

a time display operated after wakeup, the time display has a sleep operation;

the flowchart transitions in sequence from the time display to:

a time edit to;

a stop watch to;

a simple timer display to;

a fixed interval timer display to;

a fixed interval timer edit to;

a variable interval timer display to a variable timer edit to;

an alarm to;

a settings; and subsequently returns to the time display.

2. The workout cycle of claim 1, wherein the time measurement device counts with at least 1 previously programmed cycle.

3. The workout cycle of claim 1, wherein the fixed interval timer is configured to automatically start a rest cycle upon completion of the countdown.

4. The workout cycle of claim 3, wherein the fixed interval timer is configured to automatically alert the user at the completion of the rest cycle.

5. The workout cycle of claim 1, wherein the fixed interval timer will run the amount of cycles until the run of cycles is completed.

6. The workout cycle referred to in the claim 1, wherein the alarm alerts the user through at least one of a sound, a vibration, and a display illumination.

7. The workout of claim 6, wherein the alarm is configured to notify the user of a transition between cycles without the need for the user to view a display on the time measurement device.

* * * * *